US011761153B2

(12) United States Patent
Clark et al.

(10) Patent No.: US 11,761,153 B2
(45) Date of Patent: Sep. 19, 2023

(54) FORMS AND METHODS FOR CONSTRUCTING A FOUNDATION FOR SUPPORTING A HOME PLATE

(71) Applicant: Sportsfield Intellectual, LLC, Delhi, NY (US)

(72) Inventors: Sean R. Clark, Delhi, NY (US); Eric W. Hulbert, Delhi, NY (US); Andrew P. Hannigan, Delhi, NY (US); Brian Jaeger, Peachtree City, GA (US)

(73) Assignee: SPORTSFIELD INTELLECTUAL, LLC, Delhi, NY (US)

( * ) Notice: Subject to any disclaimer, the term of this patent is extended or adjusted under 35 U.S.C. 154(b) by 0 days.

(21) Appl. No.: 16/923,448

(22) Filed: Jul. 8, 2020

(65) Prior Publication Data

US 2022/0010502 A1 Jan. 13, 2022

(51) Int. Cl.

| | |
|---|---|
| ***A63B 71/00*** | (2006.01) |
| ***E01C 13/02*** | (2006.01) |
| ***A63B 69/00*** | (2006.01) |
| ***E01C 13/08*** | (2006.01) |
| ***A63C 19/00*** | (2006.01) |
| *A63B 102/18* | (2015.01) |

(52) U.S. Cl.

CPC ..... *E01C 13/02* (2013.01); *A63B 69/0013* (2013.01); *A63C 19/00* (2013.01); *E01C 13/08* (2013.01); *A63B 2102/18* (2015.10); *A63B 2102/182* (2015.10)

(58) Field of Classification Search

CPC ..... A63B 69/0013; A63B 2102/18; A63B 2102/182; A63C 19/00; E01C 13/02; E01C 13/08

USPC ..... 473/499

See application file for complete search history.

(56) References Cited

U.S. PATENT DOCUMENTS

| | | | |
|---|---|---|---|
| 315,840 | A | 4/1885 | Roberts |
| 468,625 | A | 2/1892 | Medart |
| 1,813,045 | A | 7/1931 | Franks |
| 1,887,033 | A | 11/1932 | Merriman |
| 1,928,280 | A | 9/1933 | Barron |
| 2,014,466 | A | 9/1935 | Cheyney |
| 2,064,751 | A | 12/1936 | Hussman |
| 2,200,859 | A | 5/1940 | Leonard |

(Continued)

FOREIGN PATENT DOCUMENTS

| | | |
|---|---|---|
| FR | 2601061 | 1/1988 |

OTHER PUBLICATIONS

Hand Formed Concrete Home Plate Foundation, by Clark Companies, 1 image, 1 page, Jul. 23, 2016.

(Continued)

*Primary Examiner* — Mitra Aryanpour

(74) *Attorney, Agent, or Firm* — Heslin Rothenberg Farley & Mesiti P.C.

(57) ABSTRACT

A home plate foundation form for supporting a home plate for playing baseball and softball includes, for example, an outer frame, an inner frame, and a tray. The outer frame incudes a bottom and a sidewall defining a chamber therein having an upper opening. The inner frame is supported in the chamber of the outer frame. The inner frame includes a bottom and a sidewall defining a chamber therein having an upper opening. The tray is supportable in the inner frame for adjustably supporting the home plate.

30 Claims, 15 Drawing Sheets

(56) References Cited

U.S. PATENT DOCUMENTS

| | | | | |
|---|---|---|---|---|
| 2,236,935 | A | 4/1941 | Cameron | |
| 2,294,855 | A | 9/1942 | Thomason | |
| 2,405,492 | A | 8/1946 | Corbett | |
| 2,588,722 | A | 3/1952 | Hendershott | |
| 2,678,592 | A | 5/1954 | Wiedman | |
| 2,828,931 | A | 4/1958 | Harvey | |
| 2,960,335 | A | 11/1960 | Shuttleworth | |
| 3,222,064 | A | 12/1965 | Langton | |
| 3,395,917 | A | 8/1968 | Moore | |
| 3,421,801 | A | 1/1969 | Carpenter et al. | |
| 3,477,668 | A | 11/1969 | Tippmann | |
| 3,493,201 | A | 2/1970 | Marran | |
| 3,815,902 | A | 6/1974 | Tomlinson | |
| 3,853,220 | A * | 12/1974 | Luray | B65D 81/075 206/466 |
| 4,089,553 | A | 5/1978 | Frykholm | |
| 4,212,446 | A | 7/1980 | Domanick | |
| 4,215,857 | A | 8/1980 | Gordon | |
| 4,245,838 | A | 1/1981 | Gordon | |
| 4,323,034 | A | 4/1982 | Carlson | |
| 4,502,656 | A | 3/1985 | Zeitler | |
| 4,505,449 | A | 3/1985 | Turner et al. | |
| 4,591,154 | A * | 5/1986 | Santarone | A63B 69/0002 473/497 |
| 4,666,155 | A | 5/1987 | Stille | |
| 4,696,470 | A | 9/1987 | Fenner | |
| 4,723,779 | A | 2/1988 | Hauser | |
| 4,744,561 | A | 5/1988 | Hall | |
| 4,817,946 | A | 4/1989 | Velasquez | |
| 5,080,356 | A | 1/1992 | Green et al. | |
| 5,205,799 | A | 4/1993 | Carbonero | |
| 5,259,523 | A * | 11/1993 | Scherb | B65D 11/188 206/583 |
| 5,467,977 | A | 11/1995 | Beck | |
| 5,611,974 | A | 3/1997 | Welch et al. | |
| 5,716,295 | A | 2/1998 | Anglea | |
| 5,827,140 | A | 10/1998 | Bartoli | |
| 5,894,932 | A * | 4/1999 | Harding | B65D 81/075 206/583 |
| 6,152,430 | A | 11/2000 | Thoman | |
| 6,325,352 | B1 | 12/2001 | Story | |
| 6,427,966 | B1 | 8/2002 | Blumenschein | |
| 6,767,296 | B1 | 7/2004 | Johnson | |
| 7,331,880 | B2 | 2/2008 | Rogers | |
| 7,527,569 | B2 | 5/2009 | Rogers | |
| 7,641,593 | B2 | 1/2010 | Goulet | |
| 7,736,274 | B2 | 6/2010 | Thibodeaux, Sr. | |
| 7,753,826 | B1 | 7/2010 | Oliver et al. | |
| 7,784,636 | B2 | 8/2010 | Goulet | |
| 7,798,920 | B1 | 9/2010 | Cortes | |
| 7,874,943 | B1 | 1/2011 | Chen | |
| 8,016,149 | B2 | 9/2011 | Goulet | |
| 8,172,705 | B2 | 5/2012 | Rogers | |
| 8,186,125 | B2 | 5/2012 | Goulet | |
| 8,186,684 | B2 | 5/2012 | Oliver | |
| 8,234,888 | B2 | 8/2012 | Kim et al. | |
| 8,337,318 | B2 | 12/2012 | Oliver | |
| 8,337,340 | B2 | 12/2012 | Clark | |
| 8,376,479 | B2 | 2/2013 | Furey et al. | |
| 8,578,678 | B2 | 11/2013 | Oliver | |
| 8,745,955 | B2 | 6/2014 | Goulet | |
| 8,777,784 | B2 | 7/2014 | Rogers | |
| 8,888,615 | B2 | 11/2014 | Hulbert et al. | |
| 8,925,280 | B2 | 1/2015 | Oliver | |
| 8,944,941 | B2 | 2/2015 | Carlson et al. | |
| 9,844,717 | B2 | 12/2017 | Lee et al. | |
| 9,932,893 | B2 | 4/2018 | Nandigama et al. | |
| 10,159,881 | B2 | 12/2018 | Hulbert et al. | |
| 10,392,156 | B2 * | 8/2019 | McDonald | B65D 5/3614 |
| 10,471,323 | B1 * | 11/2019 | Carlson | A63B 71/02 |
| 10,604,952 | B2 | 3/2020 | Clark et al. | |
| 10,737,129 | B2 | 8/2020 | Clark et al. | |
| 10,828,548 | B2 | 11/2020 | Markison | |
| 11,072,902 | B2 * | 7/2021 | Clark | E04G 9/06 |
| 2004/0242352 | A1 | 12/2004 | Panus | |
| 2005/0172678 | A1 | 8/2005 | Kim et al. | |
| 2008/0171621 | A1 | 7/2008 | Jacobson | |
| 2008/0305897 | A1 * | 12/2008 | Hall | A63B 69/0013 473/501 |
| 2009/0275444 | A1 | 11/2009 | Derry | |
| 2011/0098139 | A1 | 4/2011 | Query, Jr. et al. | |
| 2014/0048678 | A1 | 2/2014 | Chen et al. | |
| 2014/0187361 | A1 * | 7/2014 | Carlson | A63B 69/0002 473/497 |
| 2015/0054369 | A1 | 2/2015 | Ahlert et al. | |
| 2016/0281907 | A1 | 9/2016 | Perko | |
| 2017/0248268 | A1 | 8/2017 | Copanas et al. | |
| 2019/0055740 | A1 * | 2/2019 | Clark | E02D 27/42 |
| 2020/0270880 | A1 * | 8/2020 | Clark | E02D 27/32 |
| 2021/0252363 | A1 * | 8/2021 | Clark | A63B 69/0013 |
| 2022/0010502 | A1 * | 1/2022 | Clark | A63B 69/0013 |
| 2022/0193514 | A1 | 6/2022 | Hulbert et al. | |

OTHER PUBLICATIONS

Synthetic Turf Field Home Plate Detail, by Clark Companies, 1 page, Jun. 22, 2016.

Wood Framed Home Plate Foundation, by Vasco Sports Contractors, 4 images, 2 pages, Dec. 10, 2015.

Clark et al., U.S. Appl. No. 62/976,861, filed Feb. 14, 2020, entitled "Systems And Methods for Securing Bases, Home Plates, Pitcher's Rubbers, and Double Bases to Synthetic Turf," Feb. 14, 2020.

Clark et al., U.S. Appl. No. 16/826,398, filed Mar. 23, 2020, entitled "Forms For Constructing Foundations For Anchoring Pole Vault Standards," Mar. 23, 2020.

Clark et al., U.S. Appl. No. 18/048,601, entitled "Forms for Constructing a Foundation for Batter's and Catcher's Boxes, and Supporting a Home Plate", filed Oct. 21, 2022.

Home Plate Forming System, available from Sportsfield Specialties of Delhi, New York, printout on Oct. 21, 2022, Wayback Verification Crawl Presence at https://web.archive.org/web/20200922131545/https://www.sportsfield.com/products/baseball-softball/bases-plates-pitching-rubbers/home-plate-forming-system#gallery and https://web.archive.org/web/20210814091931/https://www.sportsfield.com/, dated Sep. 22, 2020, and Aug. 14, 2021), 9 pages, Sep. 22, 2020.

Communications Box installed at Mynderse Academy, Seneca Falls CSD, New York, installed summer 2012, and image from ComBox installation instructions, 1 page, 2012.

Combox+ Installation Instructions for Synthetic Infill Turf Field Applications For Model # CBIT1830 Combox+ and Model # CBIT1815 Combox+, available form Sportsfield Specialties, Inc., Delhi, New York, 7 pages, 2017.

Pitching Mound Forming System, manufactured by Sportsfield Specialties, Inc., Delhi, New York, printout on Dec. 20, 2020, available at https://www.sportsfield.com/products/baseball-softball/pitching-mounds/forming- systems, 10 pages, Dec. 20, 2020.

Porta-Pitch Baseball Pitcher's Mound, manufactured by Sportsfield Specialties, Delhi, Inc., New York, printout on Dec. 20, 2020, Wayback Verification Crawl Presence, https://web.archive.org/web/20190313034947/https://www.sportsfieldspecialties.com/products/baseball-softball/portable-pitching-mounds, 9 pages, Mar. 13, 2019.

Hand Made Wooden Form, fabricated by Paragon Sports Constructors, 4 images, 2 pages, at least as early as Jun. 6, 2018.

7141 & 7142—National Pole Vault Standards, available from gillathletics.com, printout available online on Jun. 26, 2017, at: https://www.gillathletics.com/files/inst-7141-7142.pdf, 7-pages Jan. 10, 2013.

PVS-NCAA Collegiate Premier Pole Vault Standards, available from Aluminum Athletic Equipment Co., Royersford, Pennsylvania, printout available online on Jun. 26, 2017, at: https://www.aaesports.com/v/vspfiles/assets/docs/pvs-ncaa-packet.pdf, 4-pages Feb. 12, 2012.

Olympian Pole Vault Standards Installation Instructions, available from Stackhouse Athletic Equip Inc., Salem, Oregon, printout available online on Jun. 26, 2017, at: https://www.stackhouseathletic.com/Content/downloads/install/TOPVS- INSTALL.pdf, 4-pages. Dec. 2008.

(56) References Cited

OTHER PUBLICATIONS

Hulbert et al., U.S. Appl. No. 17/455,745, filed Nov. 19, 2021, entitled "Forms and Methods For Constructing a Pitching Mound For Use On a Synthetic Turf Field".
First Office Action, U.S. Appl. No. 17/175,643, dated Mar. 1, 2023, 9 pages, dated Mar. 1, 2023.

* cited by examiner

FORMS AND METHODS FOR CONSTRUCTING A FOUNDATION FOR SUPPORTING A HOME PLATE

TECHNICAL FIELD

The present disclosure relates generally to home plates, and more particularly to forms and methods for constructing a foundation for supporting a home plate for playing baseball and softball.

BACKGROUND

Traditionally, supports for securing a home plates in synthetic turf require custom designs and fabrications. One example includes providing a wood frame formed from, e.g., 2 inch by 4 inch wood boards, having sides cut and assembled for receiving a home plate in the wood frame. The assembled wood frame is installed in and even with the surface of the ground.

FIGS. 1 and 2 illustrate an example of a prior art concrete form 1 for supporting a home plate 5. Concrete form 1 is formed using a square frame and a cutout in the shape of a home plate, e.g., a 2 inch thick rigid piece of insulation, oversized by a ½ inch. The home plate is shimmed to the desired height.

Often, the home plate foundation is an inaccurate product. In addition, the forming of the home plate foundation is labor intensive and time consuming.

SUMMARY

Shortcomings of the prior art are overcome and additional advantages are provided through the provision of a home plate foundation form for supporting a home plate for playing baseball and softball. The home plate foundation form includes, for example, an outer frame, an inner frame, and a tray. The outer frame incudes a bottom and a sidewall defining a chamber therein having an upper opening. The inner frame is supported in the chamber of the outer frame. The inner frame includes a bottom and a sidewall defining a chamber therein having an upper opening. The tray is supportable in the inner frame for adjustably positioning the home plate in the inner frame.

In another embodiment, a home plate foundation form for supporting a home plate for playing baseball and softball includes, for example, an inner frame and an outer frame. The inner frame includes a sidewall defining an upper opening and a chamber therein. The outer frame includes a sidewall defining an upper opening. The sidewall of the inner frame is spaced from the sidewall of the outer frame to define a surrounding chamber between the inner frame and the outer frame.

In another embodiment, a method for supporting a home plate on synthetic turf for playing baseball and softball includes, for example, providing the above home plate foundation form in a support structure below the synthetic turf, and disposing the home plate in the home plate foundation form.

In another embodiment, a method for adjustably supporting a home plate for playing baseball and softball includes, for example, adjusting a tray supported in a chamber in an inner frame, which inner frame is disposed in an outer frame, and supporting the home plate on the adjusted tray.

In another embodiment, a method for supporting a home plate on synthetic turf includes excavating a portion of a support structure, placing a home plate foundation form comprising an inner frame and an outer frame in the excavated portion of the support structure, placing uncured cement between the inner frame and the outer frame of the home plate foundation form, and disposing synthetic turf over the cured cement between the inner frame and the outer frame.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure is directed to home plates for playing baseball and softball. For example, a home plate foundation form, once installed, may allow for readily securing a home plate for playing baseball and softball. The home plate foundation form may be prefabricated under manufacturing conditions thereby assuring accuracy and economy. The form can be readily transported and installed to produce an accurate home plate foundation that is permanent and economical. In some embodiments, the home plate foundation form may include an adjustable tray for adjusting the position and/or orientation of the home plate to be evenly disposed relative to the upper surface of the field such as a synthetic turf field. As will be appreciated from the present description, the present disclosure may provide a home plate and synthetic turf interface to create a seamless playing surface.

Figure 1:
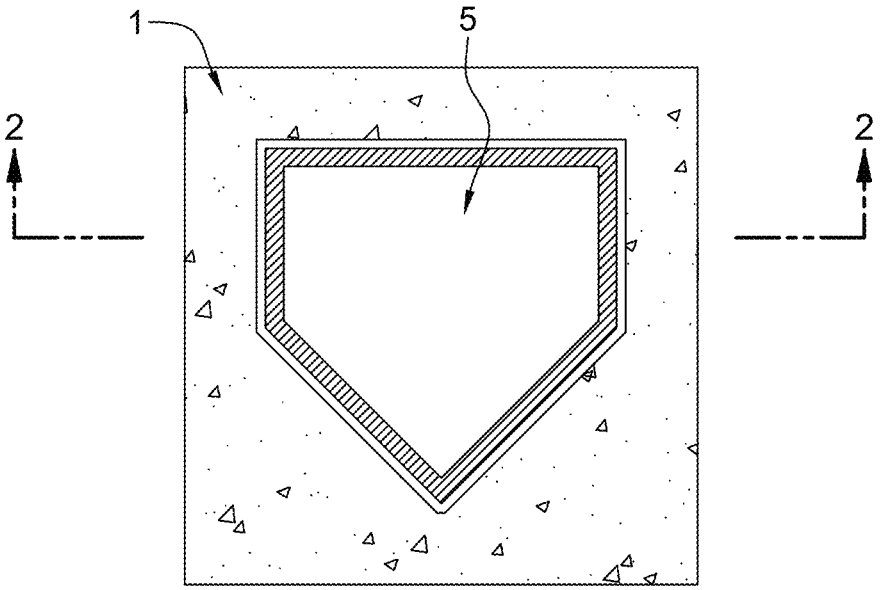
FIG. 1 (Prior Art)
FIG. 1 is a top view of a prior art home plate foundation and a home plate.
Figure 2:
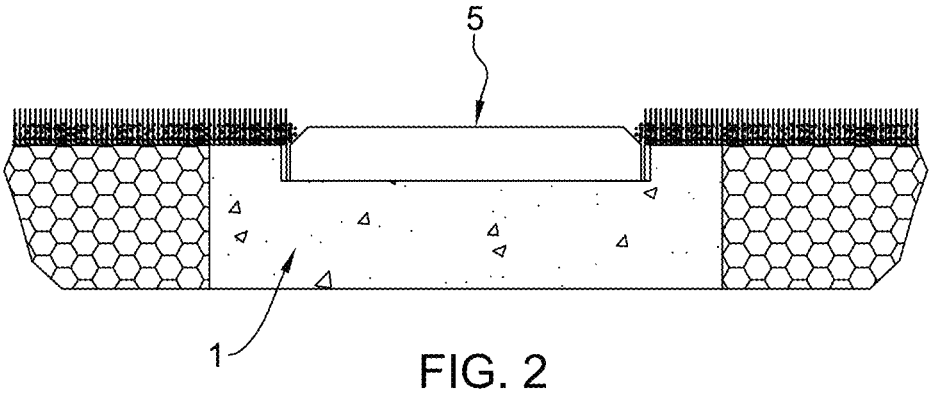
FIG. 2 (Prior Art)
FIG. 2 is a cross-sectional view of the prior art home plate foundation and home plate taken along line 2-2 in FIG. 1.
Figure 3:
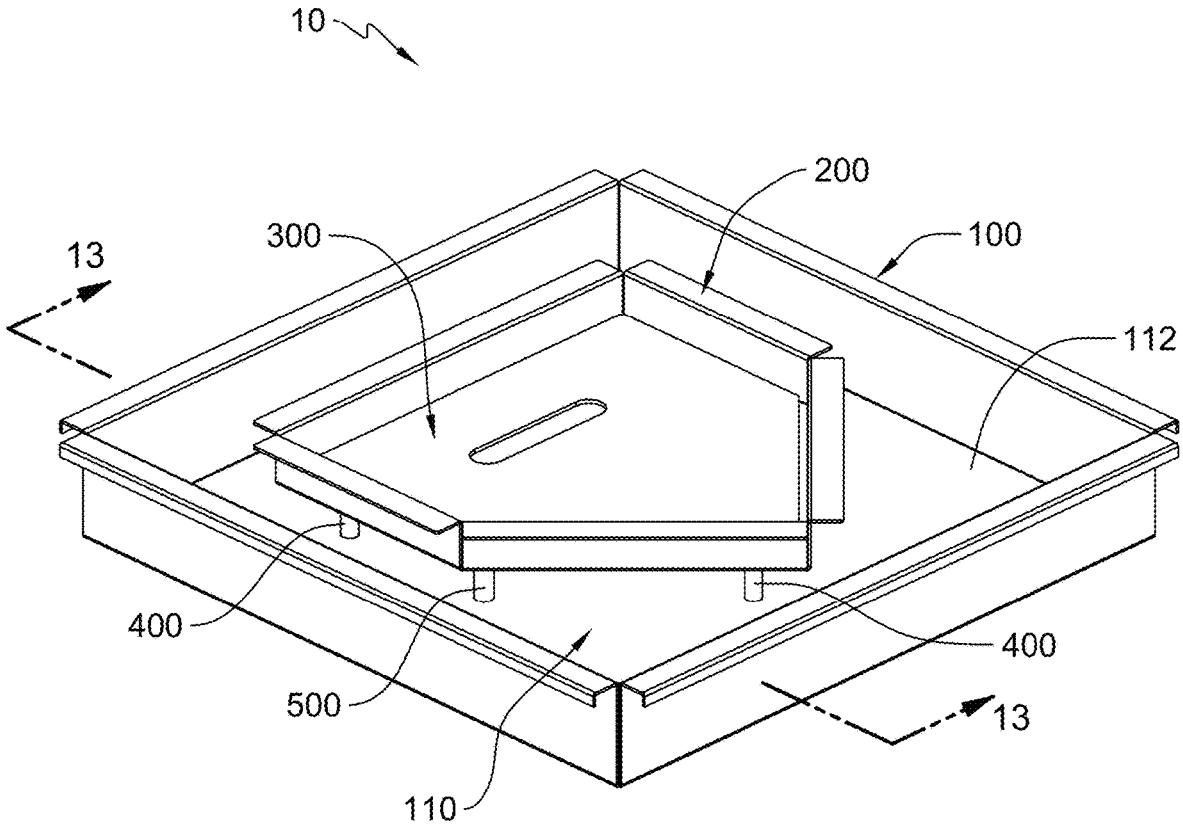
FIG. 3 is a top perspective view of a home plate foundation form for securing a home plate to a surface of synthetic turf, according to an embodiment of the present disclosure.
Figure 4:
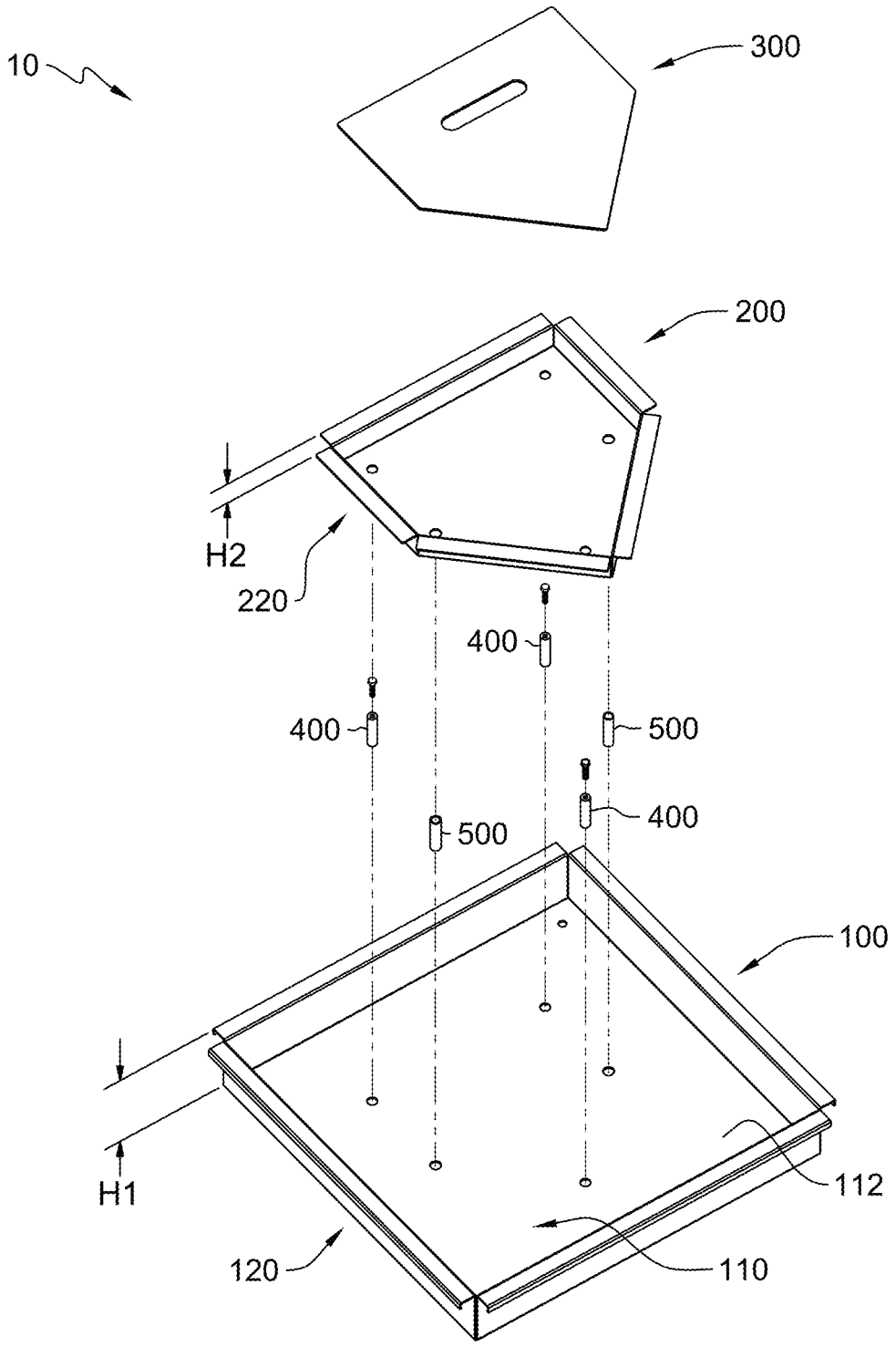
FIG. 4 is an exploded, top perspective view of the home plate foundation form of FIG. 3, according to an embodiment of the present disclosure.

With reference to FIGS. 3 and 4, therein illustrated is a home plate foundation form 10 for use beneath a surface of synthetic turf for supporting a home plate (not shown in FIGS. 3 and 4) for playing baseball and softball, according to an embodiment of the present disclosure. In this illustrated embodiment, home plate foundation form 10 may generally include an outer frame 100, an inner frame 200, and a tray 300.

Generally, inner frame 200 is supported in outer frame 100, and tray 300 is adjustably supportable in inner frame 200. As shown in FIG. 3, inner frame 200 is supported in and spaced from outer frame 100. In some embodiments, the inner frame 200 may be supported in and fixedly attached to outer frame 100. As described in greater detail below, home plate foundation form 10 may be disposed in a cavity in the ground with concrete placed between outer frame 100 and inner frame 200. For example, the concrete may be placed between the bottom of the inner frame and the bottom of the outer frame, and between the side wall of the inner frame and the sidewall of the outer frame. After installation, a home plate may be received in inner frame 200 and supported on tray 300.

Figure 5:
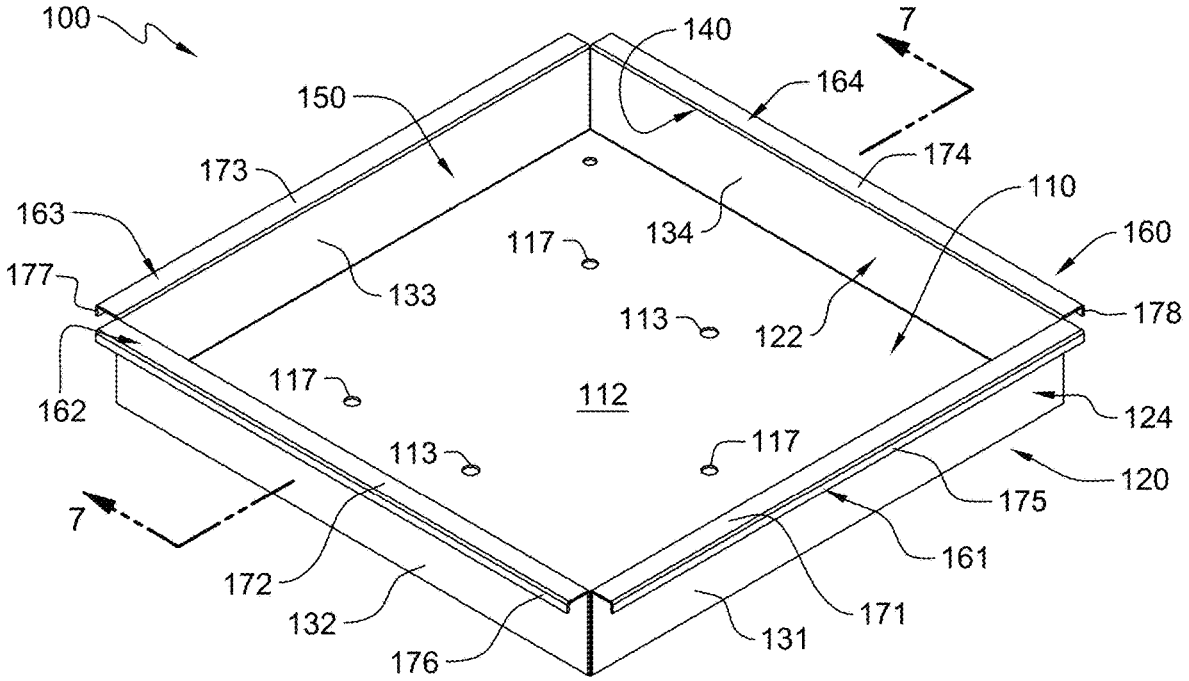
FIG. 5 is a top perspective view of the outer frame of the home plate foundation form of FIG. 3, according to an embodiment of the present disclosure.
Figure 6:
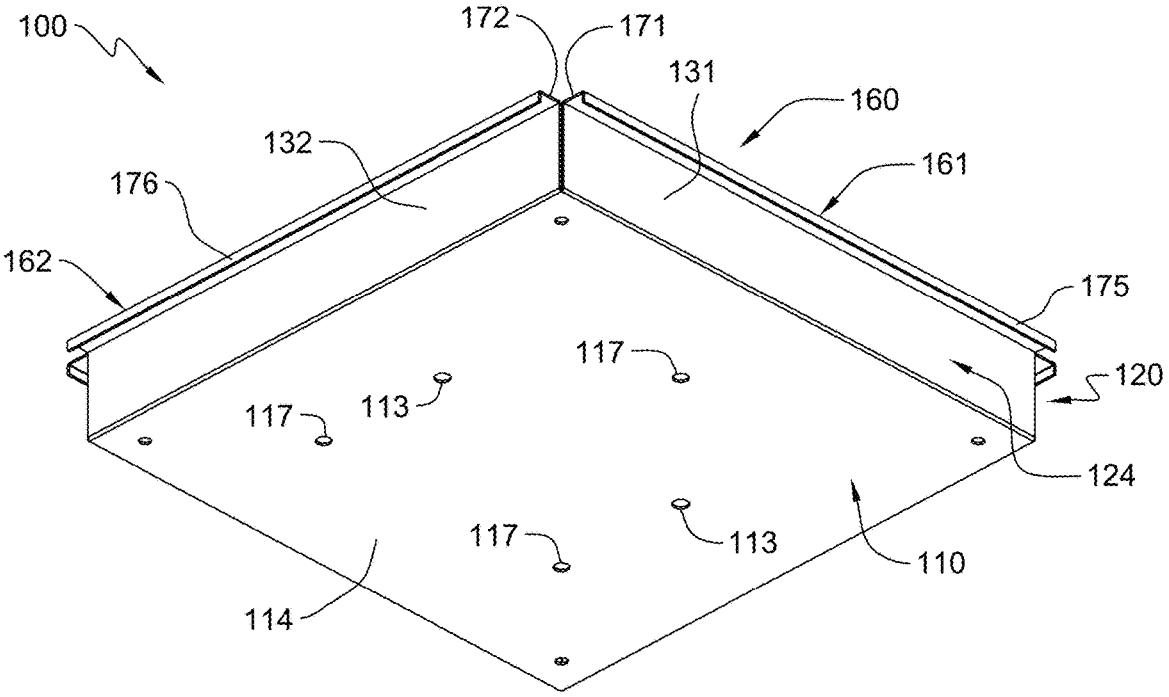
FIG. 6 is a bottom perspective view of the outer frame of the home plate foundation form of FIG. 3, according to an embodiment of the present disclosure.
Figure 7:
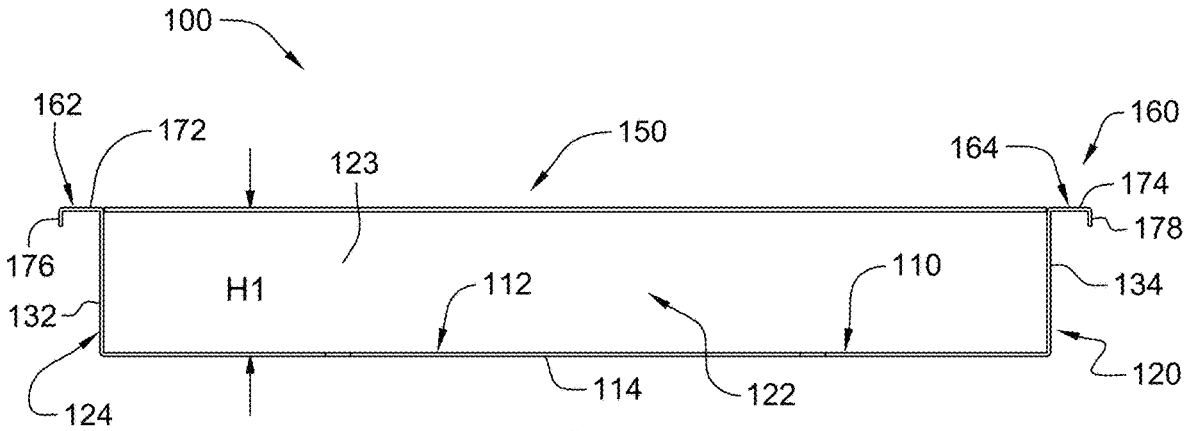
FIG. 7 is a cross-sectional view taken along line 7-7 in FIG. 5 of the outer frame, according to an embodiment of the present disclosure.

As shown in FIGS. 5-7, outer frame 100 may include a bottom 110 and a sidewall 120 such as a peripherally-extending sidewall defining an upper opening 140 (FIG. 5) and a chamber 150 therein. Bottom 110 may include an upper surface 112 and a lower surface 114. Peripherally-extending sidewall 120 may include an inner surface 122 and an outer surface 124. For example, outer frame 100 may be formed from a planar member with folded sides to provide bottom 110, peripherally-extending sidewall 120, and an outwardly-extending ledge or lip 160.

Peripheral sidewall 120 may include a first side 131, a second side 132, a third side 133 opposite first side 131, and a fourth side 134 opposite second side 132. The sides 131, 132, 133, and 134 may be vertical sides. Bottom 110 may be a square-shaped bottom and the adjacent sides may be disposed at ninety degrees from bottom 110. The adjacent sides may be disposed at ninety degrees from each other. Outer frame 100 may form chamber 150 therein.

Outwardly-extending ledge or lip 160 may extend from each of the sides, and include outwardly-extending lips 161, 162, 163, and 164 that may include a horizontal outwardly-extending portion 171, 172, 173, and 174, and a downwardly-depending distal portion 175, 176, 177, and 178, respectively. Outer frame 100 may be formed from a metallic material such as aluminum, and/or may be formed from a sheet metal material having a thickness of about ⅛ inch. The corners of the sides may or may not be welded together.

Figure 8:
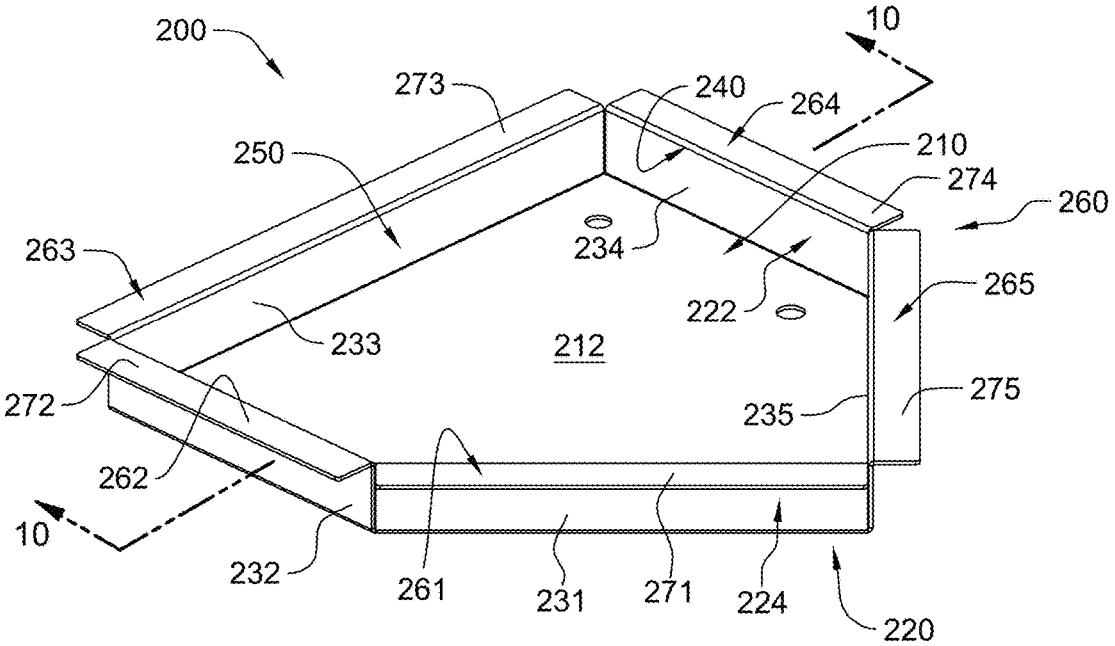
FIG. 8 is a top perspective view of the inner frame of the home plate foundation form of FIG. 3, according to an embodiment of the present disclosure.
Figure 9:
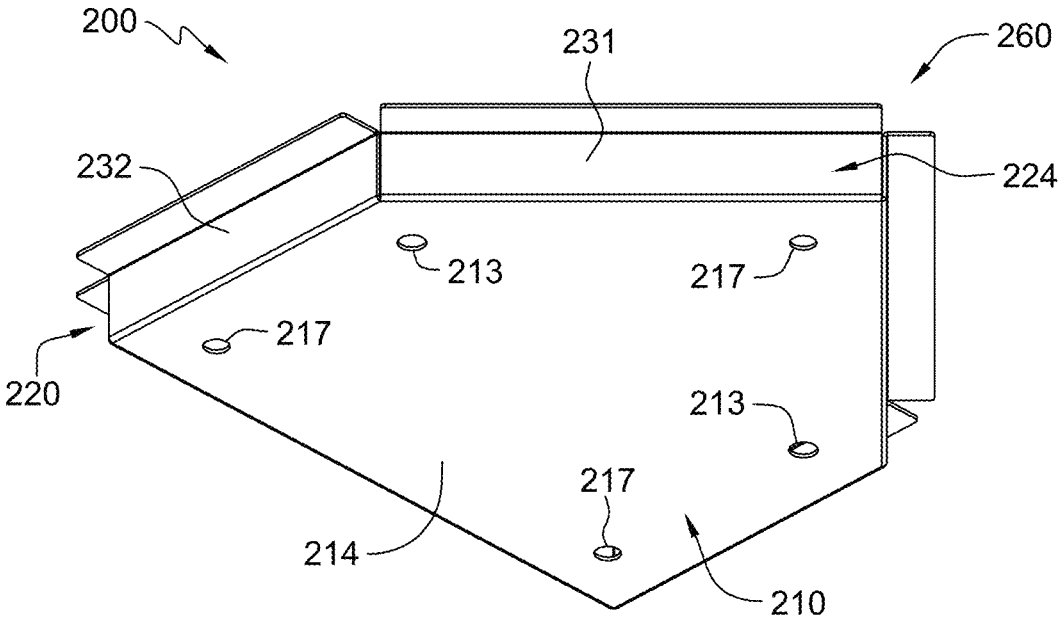
FIG. 9 is a bottom perspective view of the inner frame of the home plate foundation form of FIG. 3, according to an embodiment of the present disclosure.
Figure 10:
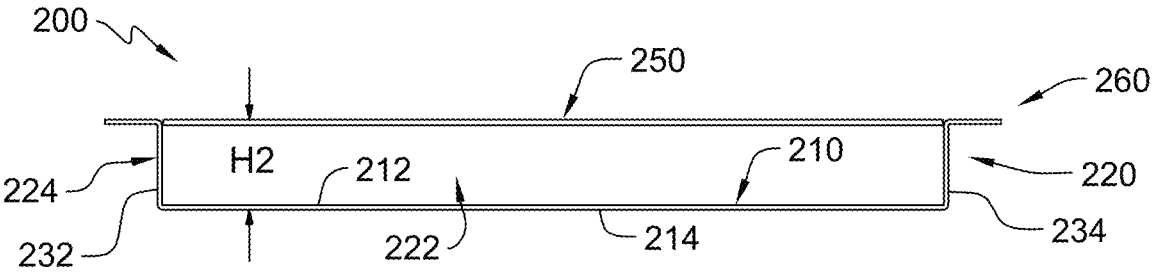
FIG. 10 is a cross-sectional view taken along line 10-10 in FIG. 8 of the inner frame, according to an embodiment of the present disclosure.

As shown in FIGS. 8-10, inner frame 200 may include a bottom 210 and a sidewall 220 such as a peripherally-extending sidewall defining an upper opening 240 (FIG. 8) and a chamber 250 therein. Bottom 210 may include an upper surface 212 and a lower surface 214. Peripherally-extending sidewall 220 may include an inner surface 222 and an outer surface 224. For example, inner frame 200 may be formed from a planar member with folded sides to provide bottom 210 and peripherally-extending sidewall 220. In some embodiments, inner frame 200 may include an outwardly-extending ledge or lip 260.

Peripheral sidewall 220 may include a first side 231, a second side 232, a third side 233, a fourth side 234 opposite second side 232, and a fifth side 235. The sides 231, 232, 233, 234, and 235 may be vertical sides. Bottom 210 may be a five-sided bottom having a planar irregular pentagon shape and the adjacent sides may be disposed at ninety degrees from bottom 210. Adjacent sides 232, 233, and 234 may be disposed at ninety degrees from each other. Adjacent sides 231 and 235 may be disposed at ninety degrees from each other. Inner frame 200 may form chamber 250 therein. Bottom 210 may be sized slightly larger than a home place so that the home plate may be received in the chamber of inner frame 200 as described below. For example, bottom 210 may have a length of slightly larger than 17 inches adjacent to side 223, a length slightly larger than 8.5 inches adjacent to sides 232 and 234, and a length slightly larger than 12 inches adjacent to sides 231 and 235. For example, the size of the bottom may provide a ½ inch spacing around a conventional home plate.

Outwardly-extending ledge or lip 260 may extend from each of the sides, and include an outwardly-extending lip 261, 262, 263, 264, and 265 that may include a horizontal outwardly-extending portion 271, 272, 273, 274, and 275, respectively. Inner frame 200 may be formed from a metallic material such as aluminum, and/or may be formed from a sheet metal material having a thickness of about ⅛ inch. The corners or intersections of the sides may or may not be welded together.

With reference again to FIGS. 4, 7, and 10, a height H1 of sidewall 120 of outer frame 100 may be greater than a height H2 of sidewall 220 of inner frame 200. For example, height H1 of sidewall 120 of frame 100 may be about 5 inches, and height H2 of sidewall 220 of frame 200 may be about 2 inches to about 2½ inches. While each of the outer and inner frames may be formed from a single sheet material, it will be appreciated that the outer frame and/or the inner frame may be formed from two or more components. It will be appreciated that the bottom of the outer frame may have other configurations other than square such as rectangular, round, or other suitable configuration.

Figure 11:
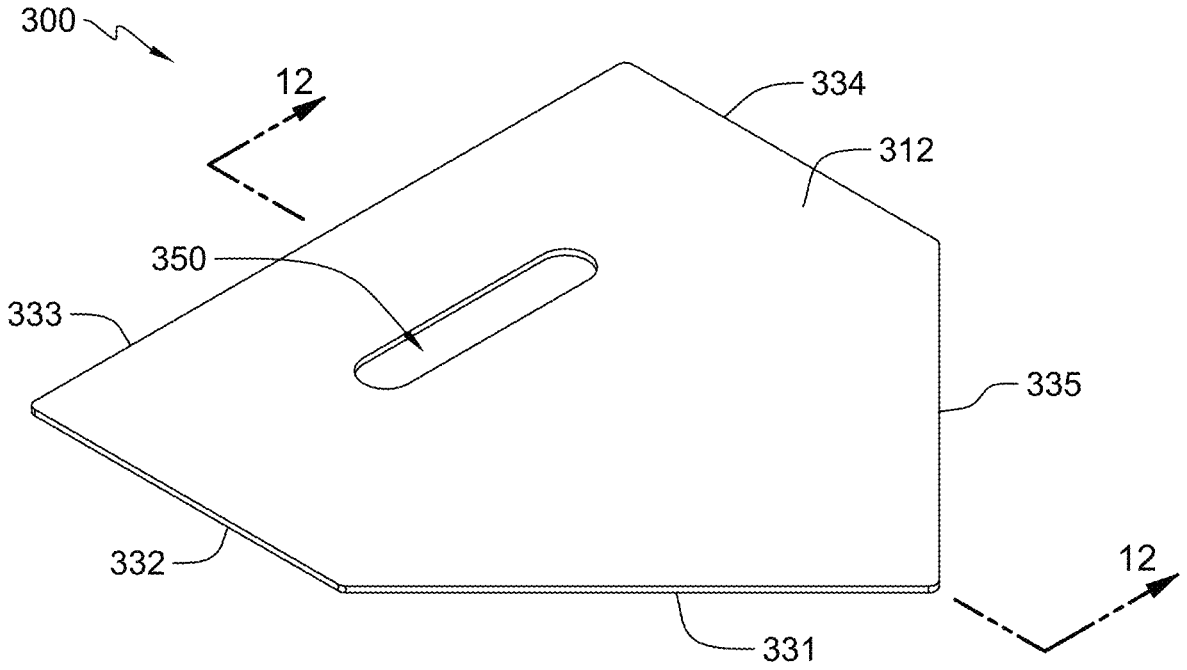
FIG. 11 is a top perspective view of the tray of the home plate foundation form of FIG. 3, according to an embodiment of the present disclosure.
Figure 12:
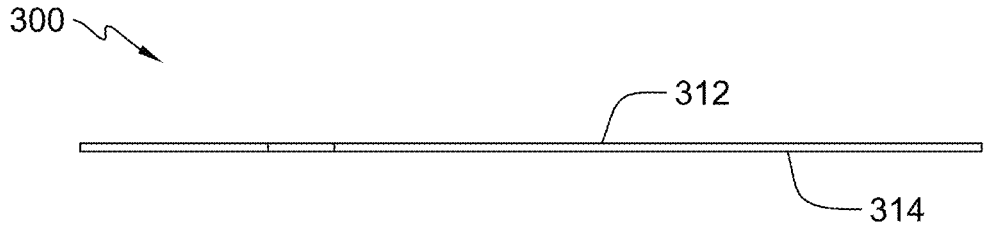
FIG. 12 is a cross-sectional view taken along line 12-12 in FIG. 11 of the tray, according to an embodiment of the present disclosure.

As shown in FIG. 11, tray 300 may be a five-sided planar member having an irregular pentagon shape. For example, tray 300 may have an upper surface 312 and a lower surface 314. Tray 300 may have a first edge 331, a second edge 232, a third edge 233, a fourth edge 234 opposite second edge 232, and a fifth edge 235. For example, first edge 331 and fifth edge 335 may have a length of about 12 inches, edges 232 and 234 may have a length of about 8.5 inches, and edge 333 may have a length of about 17 inches. Tray 300 may be sized slightly smaller than inner frame 200 so that tray 300 is receivable in inner frame 200. In some embodiments, tray 300 may include an opening 350, such as an obround opening, operable to provide a handle. Tray 300 may be formed from a metallic material such as aluminum, and/or may be formed from a sheet metal material having a thickness of about 3/16 inch.

With reference again to FIGS. 3 and 4, in some embodiments, inner frame 200 may be supported in and fixedly attached to outer frame 100. For example, a plurality of supports 400 and/or a plurality of drain tubes 500 may be disposed between lower surface 214 (FIG. 9) of bottom 210 of inner frame 200 and upper surface 112 of bottom 110 of outer frame 100 to support inner frame 200 spaced from outer frame 100.

Figure 13:
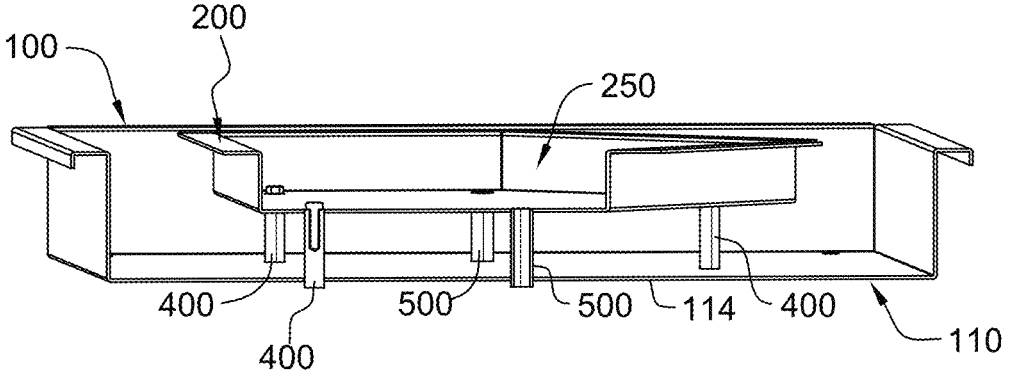
FIG. 13 is a perspective cross-sectional view taken along line 13-13 in FIG. 3 of the home plate foundation form, according to an embodiment of the present disclosure.
Figure 21:
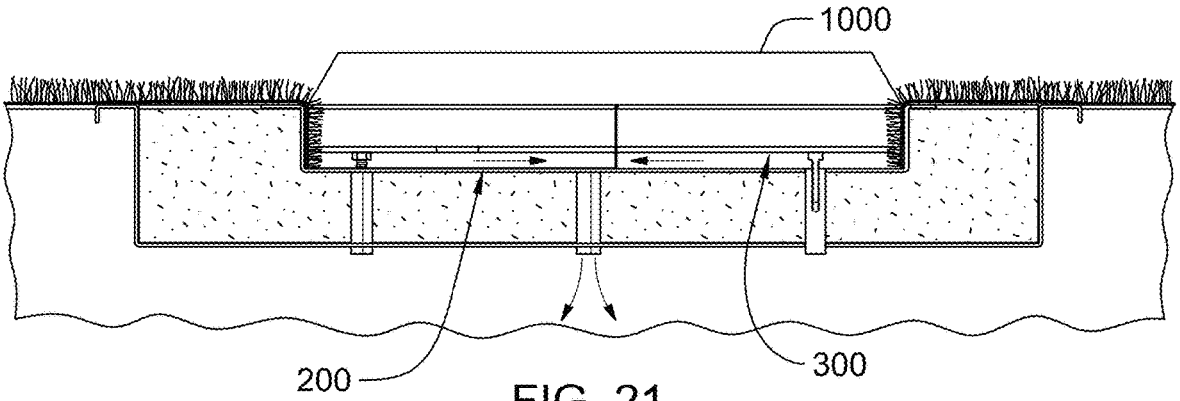

As shown in FIG. 13, drain tubes 500 may provide fluid communication between chamber 250 of inner frame 200 and bottom surface 114 of bottom 110 of outer frame 100. As described below, once home plate foundation form 10 (FIG. 21) is installed in the ground, water passing between a home plate 1000 (FIG. 21) and inner frame 200 will be able to drain out of the installed home plate foundation form 10 (FIG. 21). The drain tubes may include two hollow cylindrical drain tubes, with one spaced on one side of the inner and outer frames and the other on the other side of the inner and outer frames.

Figure 14:
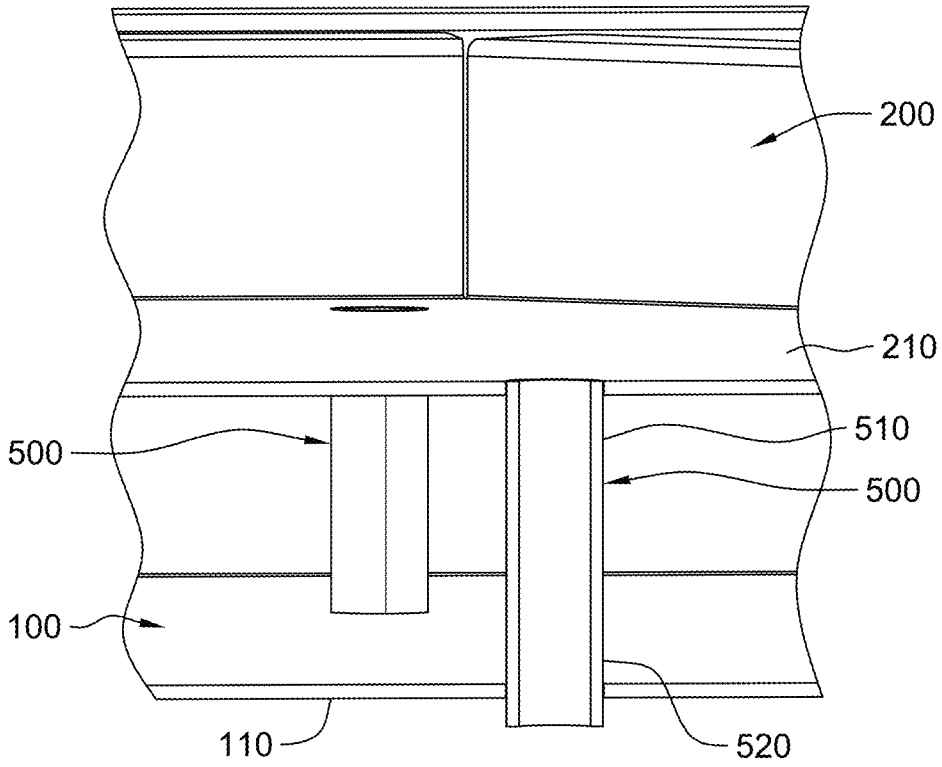
FIG. 14 is an enlarged view of a portion of the perspective cross-sectional view of FIG. 13 illustrating the drain tubes, according to an embodiment of the present disclosure.

As shown in FIG. 14, drain tube 500 may have a first end portion 510 and a second end portion 520. First end portion 510 may be operably attached to bottom 210 of inner frame 200. For example, bottom 210 of inner frame 200 may have a pair of holes 213 (FIG. 9). First end portion 510 of drain tube 500 may extend through hole 213 (FIG. 9) and be operably secured such as in a press fit manner, by welding, or another suitable attachment manner. Second end portion 520 may be operably attached and extend through bottom 110 of outer frame 100. For example, bottom 110 of outer frame 100 may have a pair of holes 113 (FIGS. 5 and 6). Second end portion 520 of drain tube 500 may extend through hole 213 (FIG. 9) and be operably secured such as in a press fit manner, by welding, or another suitable attachment manner. It will be appreciated that the drawings and/or drain tubes may be disposed in other locations of the home plate foundation form, and/or extend other portions of the home plate foundation form.

Figure 15:
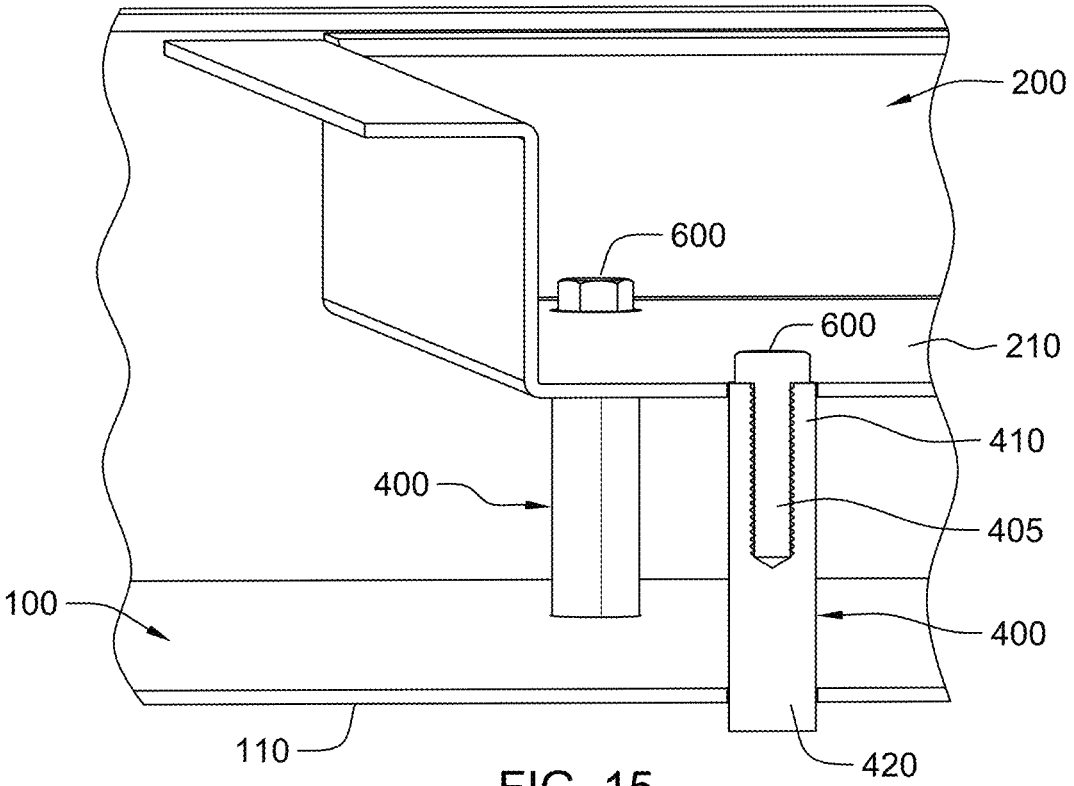
FIG. 15 is an enlarged view of a portion of the perspective cross-sectional view of FIG. 13 illustrating the supports, according to an embodiment of the present disclosure.

As shown in FIG. 15, support 400 may have a first end portion 410 and a second end portion 420. First end portion 410 may be operably attached to bottom 210 of inner frame 200. For example, bottom 210 of inner frame 200 may have a plurality of holes of holes 217 (FIG. 9). Upper end portion 410 of support 400 may extend through hole 217 (FIG. 9) and be operably secured such as in a press fit manner, by welding, or another suitable attachment manner. Second end portion 420 may be operably attached and extend through bottom 110 of outer frame 100. For example, bottom 110 of outer frame 100 may have a plurality of holes 117 (FIGS. 5 and 6). Second end portion of supports 500 may extend through holes 117 (FIG. 6) and be operably secured such as in a press fit manner, by welding, or another suitable attachment manner.

In some embodiments, support 400 may also be employed in adjustably positioning tray 300 (FIGS. 3 and 4). For example, support 400 may include a threaded opening 405 for receiving a threaded member 600. In this illustrated embodiment, support 400 may receive threaded member 600 for adjustably positioning and orienting tray 300. For example, each of supports 400 and threaded members 600 may be disposed adjacent a different one of the three right angles of inner frame 200.

Figure 16:
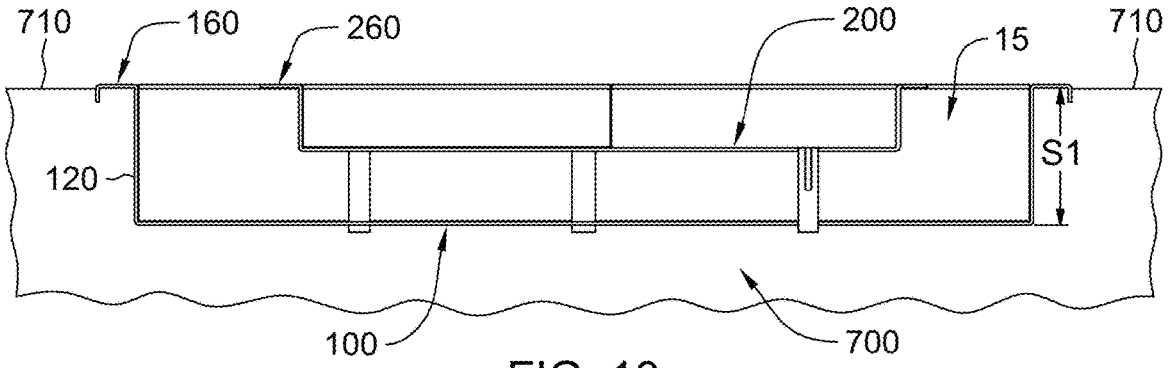
FIGS. 16-21 are side elevational views of a method for installing the home plate foundation form of FIG. 3, according to an embodiment of the present disclosure.

FIGS. 16-21 diagrammatically illustrate a method for installing home plate foundation form 10 for constructing a foundation for securing a home plate in a synthetic turf for playing baseball or softball, according to an embodiment of the present disclosure. Initially, as shown in FIG. 16, a support structure 700 such as the ground is excavated to provide a cavity having a depth S1 sized and corresponding to height H1 (FIG. 7) of outer frame 110. The cavity may have a length and width sized larger than the length and width of outer frame 110. After placing the sub-assembly of outer frame 110 and inner frame 200 in the cavity, the space around outer sidewall 120 of outer frame may be back filled. The top surface of the inner frame 200 or lip 260, and a top surface or lip 160 of outer frame 100 may be disposed even with a top surface 710 of support structure 700.

Figure 17:
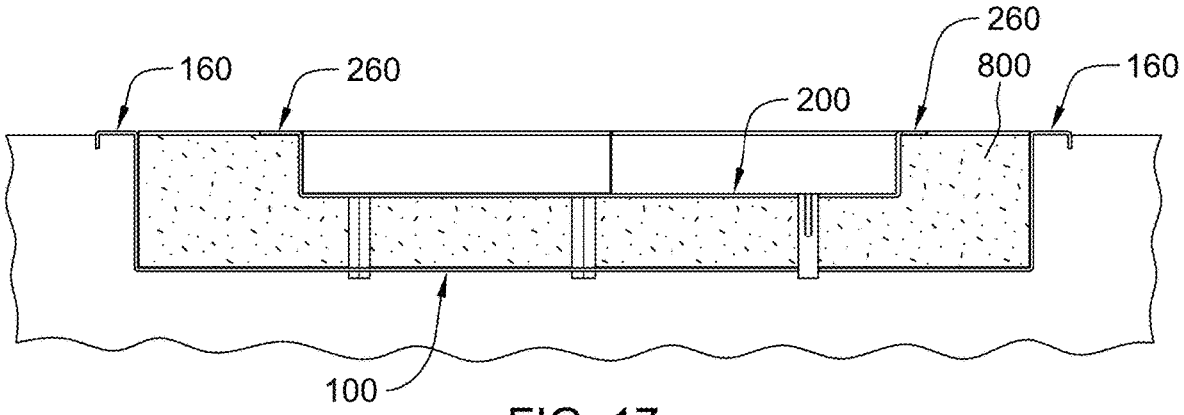

As shown in FIG. 17, uncured concrete 800 is poured into or placed in the space of a surrounding chamber 15 (FIG. 16) between outer frame 100 and inner frame 200. Lip 160 of outer frame 100, and lip 260 of the inner frame 200 allow screeding or passing a leveling device over the uncured concrete to provide a level and/or an evenly uncured concrete surface. The concrete is allowed to cure and harden so that the outer frame and the inner frame are anchored to the ground.

Figure 18:
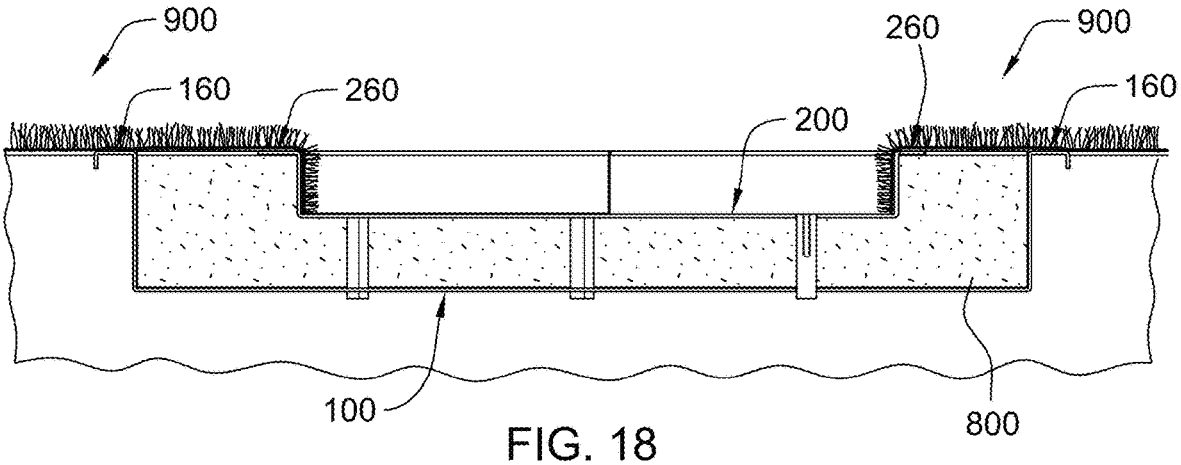

As shown in FIG. 18, a synthetic turf 900 may be disposed over lip 160 of outer frame 100, over the cured concrete 800, and over lip 260 of inner frame 200. Synthetic turf 900 may define an opening corresponding to the opening of the chamber in inner frame 200. In some embodiments, synthetic turf 900 may continue over lip 260 and extend down the inside of inner frame 200. Synthetic turf 900 may be secured to the inside vertical side of inner frame 200 with self-tapping screws. In some embodiments, depending on the thickness of the synthetic turf or the density of the fibers or "thatch layer", the synthetic turf fibers of the synthetic turf may be shaved down as necessary during this step to allow for clearance for receiving the tray and/or the home plate. By securing the synthetic turf inside the inner frame, a friction fit may be achieved with the home plate. Infill material will be used to smooth out the transition between the synthetic turf and the home plate. A benefit of securing the synthetic turf to the inside of the inner frame is that the synthetic material will resist peeling up from players sliding into home plate compared to terminating the synthetic turf at the edges of the sides of the inner frame and adhering to the synthetic turf to the horizontal lips of the inner frame.

Figure 19:
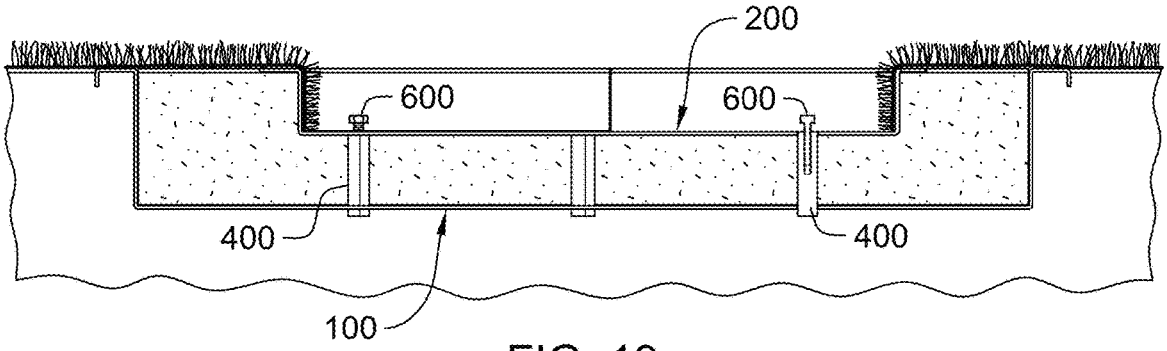
Figure 20:
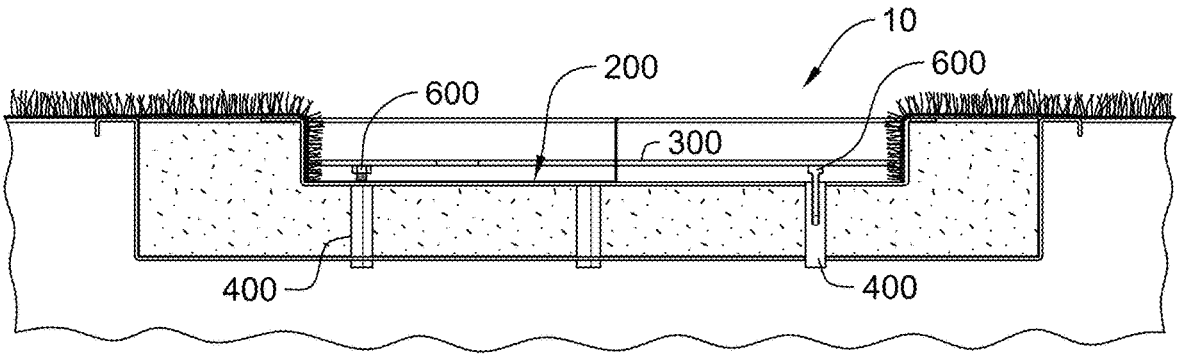
Figure 22:
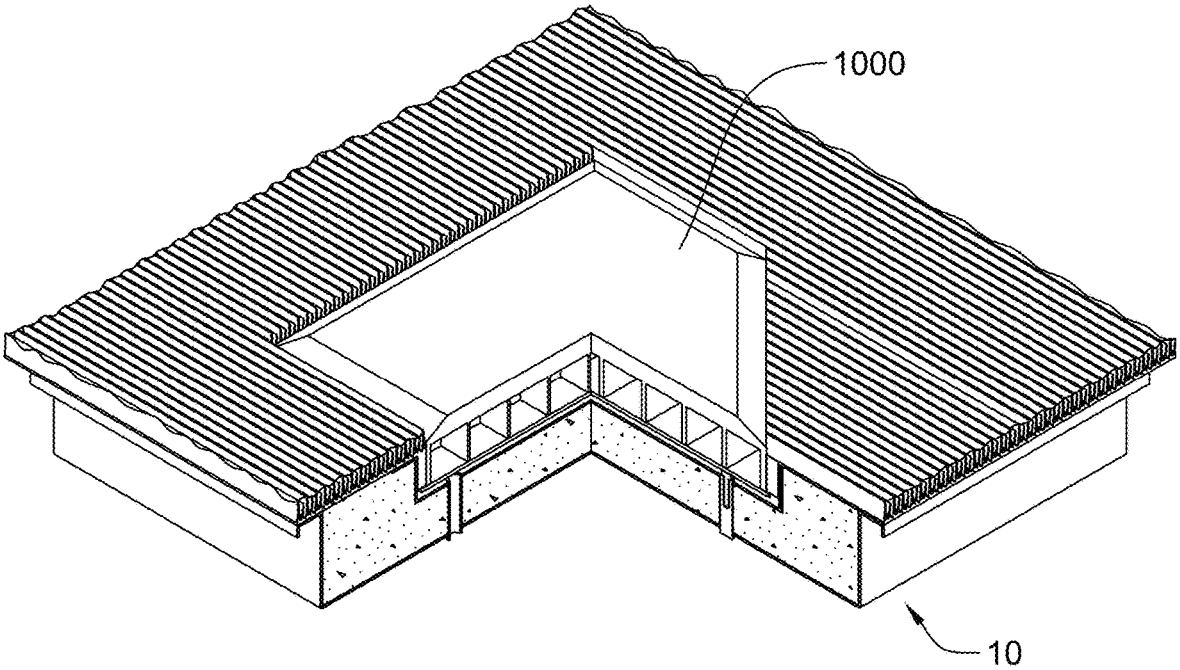
FIG. 22 is a perspective view, partially cut-away, of the home plate foundation form of FIG. 3 along with a home plate and synthetic turf, according to an embodiment of the present disclosure.

Thereafter, as shown in FIG. 19, threaded members 600 may be installed in supports 400, and tray 300 placed in inner frame 200 and disposed on threaded members 600 as shown in FIG. 20. As shown in FIGS. 21 and 22, home plate 1000 may be placed in inner frame 200 and supported on tray 300. The home plate may be a standard or conventional home plate. In some embodiments, the home plate may be a reversible home plate.

Figure 23:
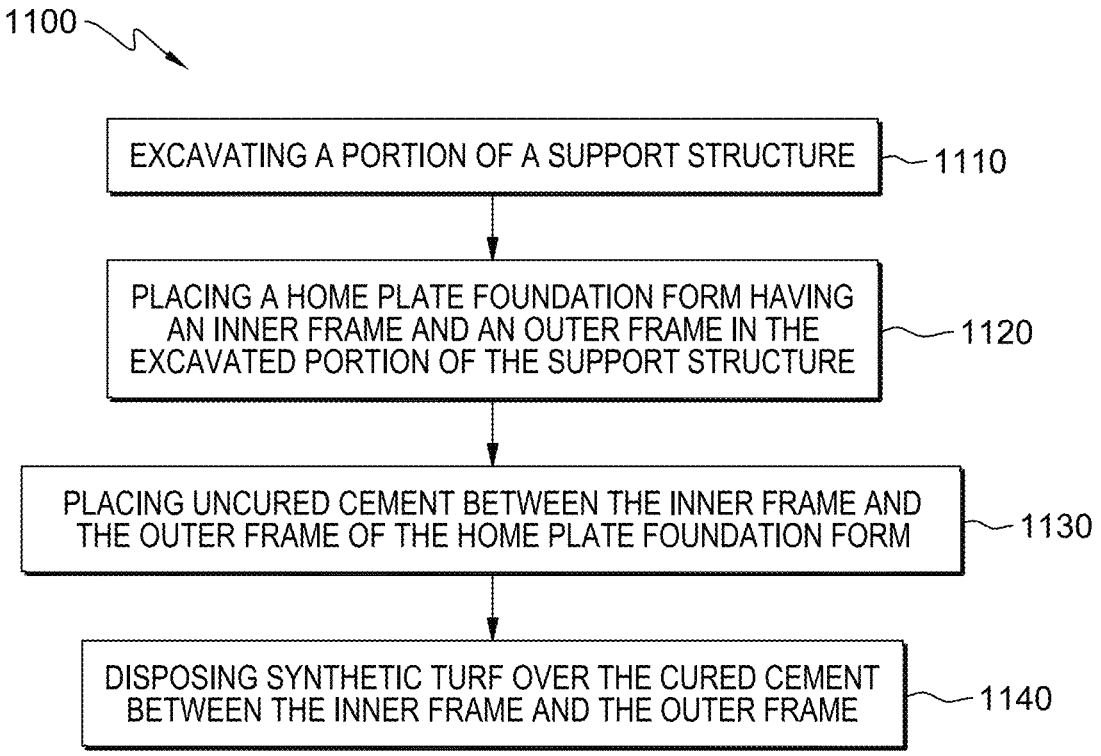
FIG. 23 is a flowchart of a method for supporting a home plate on synthetic turf, according to an embodiment of the present disclosure.

FIG. 23 illustrates a method 1100 for supporting a home plate on synthetic turf, according to an embodiment of the present disclosure. In this illustrated embodiment, method 1100 may include, at 1110 excavating a portion of a support structure, at 1120 placing a home plate foundation form comprising an inner frame and an outer frame in the excavated portion of the support structure, at 1130 placing uncured cement between the inner frame and the outer frame of the home plate foundation form, and at 1140 disposing synthetic turf over the cured cement between the inner frame and the outer frame.

Figure 24:
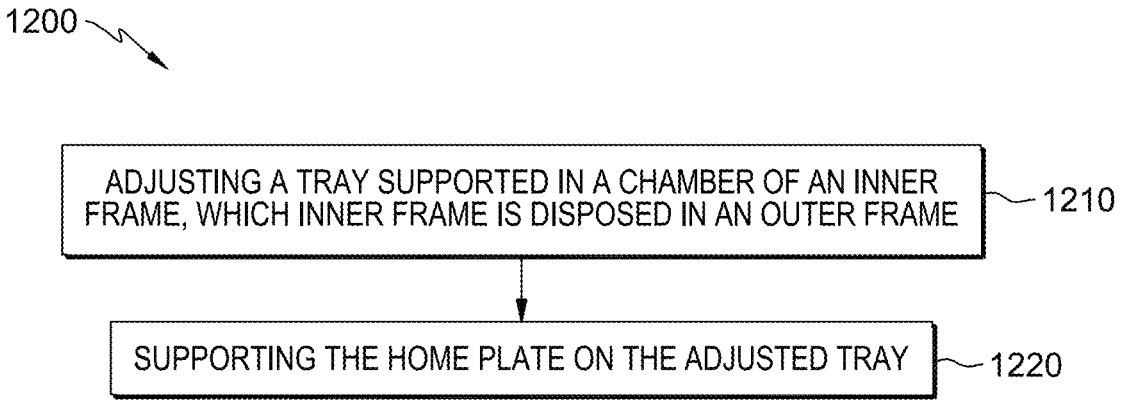
FIG. 24 is a flowchart of a method for adjustably supporting a home plate on synthetic turf, according to an embodiment of the present disclosure.

FIG. 24 illustrates a method 1200 for supporting a home plate on synthetic turf, according to an embodiment of the present disclosure. In this illustrated embodiment, method 1200 includes, at 1210 adjusting a tray supported in a chamber of an inner frame, which inner frame is disposed in an outer frame, and at 1220 supporting the home plate on the adjusted tray.

In other embodiments, the supports for attaching the inner frame to the outer frame may be C-channel members, Z-shaped members, L-shaped members, and/or other suitable member. In some embodiments, the supports may operably extend between and attach to the sidewalls of the inner frame and outer frame.

In other embodiments, a home plate foundation form may not include a tray. For example, shims may be used for adjusting the position and orientation of the supported home plate on the bottom of the inner frame.

In some embodiments, the inner frame need not include a bottom. For example, one or more inner sidewalls may extend and directly connected to the bottom of the outer frame. During instillation, concrete may be disposed around the one or more inner sidewalls so as to extend between the one or more inner sidewalls of the inner frame and the outer sidewall of the outer frame. A platform or support members may extend from the bottom of the outer frame or across the one or more inner sidewalls of the inner frame for supporting a home plate using shims, or supporting a home plate on an adjustable tray.

Figure 25:
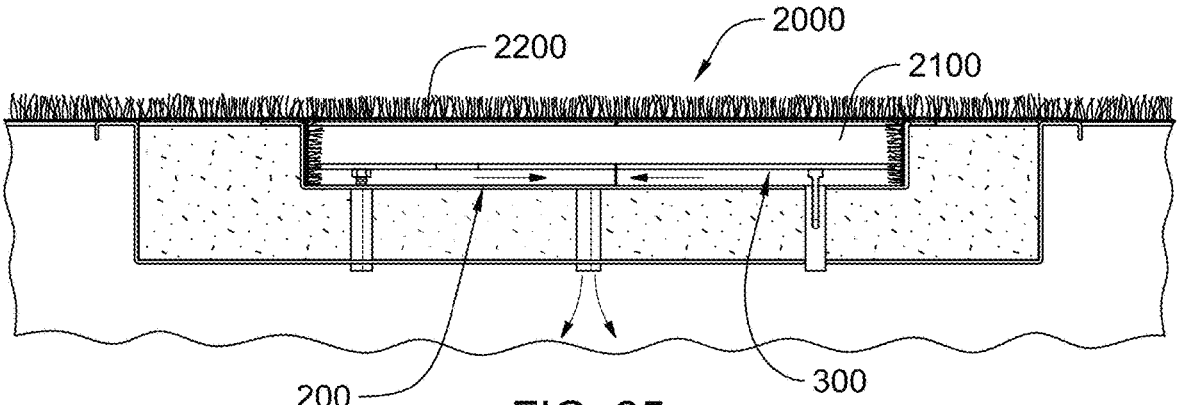
FIG. 25 is a side elevational view of the home plate foundation form of FIG. 3 along with a removable cover plug, according to an embodiment of the present disclosure.

With reference to FIG. 25, in some embodiments, when the playing field is not used for baseball or softball, such as when the playing field is used for soccer, the home plate may be removed and replaced with a removable cover plug 2000, in accordance with the present disclosure. For example, removable cover plug 2000 may be in the shape of a home plate and include a base 2100 and synthetic turf 2200.

It will be appreciated from the present description that the technique of present disclosure may provide a simplified or streamlined installation and quality control. The ability to adjust the height of the home plate allows adjustment due to fluctuations of the synthetic turf elevation over time, due to compaction, displacement, or replenishment of infill materials, to maintain the home plate even or flush with the surrounding synthetic turf surface for safe sliding. Other benefits of the present disclosure include synthetic turf attachment provisions, integral drainage, integral screed flanges or lips for leveling the uncured concrete, and replaceability of a home plate or use with a reversible home plate.

As may be recognized by those of ordinary skill in the art based on the teachings herein, numerous changes and modifications may be made to the above-described and other embodiments of the present disclosure without departing from the scope of the disclosure. The components of the home plate foundation forms as disclosed in the specification, including the accompanying abstract and drawings, may be replaced by alternative component(s) or feature(s), such as those disclosed in another embodiment, which serve the same, equivalent or similar purpose as known by those skilled in the art to achieve the same, equivalent or similar results by such alternative component(s) or feature(s) to provide a similar function for the intended purpose. In addition, the home plate foundation forms may include more or fewer components or features than the embodiments as described and illustrated herein. Accordingly, this detailed description of the currently-preferred embodiments is to be taken in an illustrative, as opposed to limiting of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The disclosure has been described with reference to the preferred embodiments. It will be understood that the embodiments described herein are exemplary of a plurality of possible arrangements to provide the same general features, characteristics, and general system operation. Modifications and alterations will occur to others upon a reading and understanding of the preceding detailed description. It is intended that the disclosure be construed as including all such modifications and alterations.

The invention claimed is:

1. A home plate foundation form for supporting a home plate for playing baseball and softball, said home plate foundation form comprising:

an outer frame comprising a sidewall having an outer surface and an inner surface defining a chamber therein having an upper opening;

an inner frame supportable in said chamber of said outer frame, said inner frame comprising a bottom and a sidewall defining a chamber therein having an upper opening, said inner frame extending below said upper opening of said outer frame;

a tray supportable in said chamber of said inner frame and below said upper opening of said outer frame for adjustably positioning the home plate in said inner frame;

wherein said bottom of said inner frame comprises an irregular pentagon shaped bottom, said sidewall of said inner frame comprises a first side, a second side, a third side, a fourth side, and a fifth side, and said upper opening of said inner frame having an irregular pentagon shaped opening;

wherein said sidewall of said inner frame is spaced from said sidewall of said outer frame to define a surrounding chamber between said side wall of said inner frame and said side wall of said outer frame;

wherein said outer frame is formed from a metallic material; and wherein said inner frame is formed from a metallic material.

2. The home plate foundation form of claim 1 wherein said outer frame comprises a bottom, and said bottom of said inner frame is spaced from said bottom of said outer frame.

3. The home plate foundation form of claim 1 wherein said inner frame is fixedly supported in said outer frame.

4. The home plate foundation form of claim 2 further comprising at least one support disposed in the chamber of said outer frame and extending between said bottom of said inner frame and said bottom of said outer frame for supporting said bottom of said inner frame spaced from said bottom of said outer frame, and said sidewall of said inner frame spaced from said sidewall of said outer frame.

5. The home plate foundation form of claim 1 further comprising a plurality of members for adjustably vertically spacing said tray from an upper surface of said bottom of said inner frame.

6. The home plate foundation form of claim 1 further comprising at least one drain in fluid communication between said chamber of said inner frame and a bottom surface of said outer frame.

7. The home plate foundation form of claim 1 wherein a height of said sidewall of said outer frame is greater than a height of said sidewall of said inner frame.

8. The home plate foundation form of claim 1 wherein said tray comprises a handle opening.

9. The home plate foundation form of claim 2 further comprising:

a plurality of supports extending between said bottom of said inner frame and said bottom of said outer frame for supporting said bottom of said inner frame spaced from said bottom of said outer frame, and said sidewall of said inner frame spaced from said sidewall of said outer frame;

a plurality of threaded members for adjustably spacing said tray from an upper surface of said bottom of said inner frame, said plurality of threaded member receivable in threaded openings in said plurality of supports; and at least one drain tube in fluid communication between said chamber of said inner frame and a bottom surface of said bottom of said outer frame.

10. The home plate foundation form of claim 9 wherein said tray comprises a planar irregular pentagon shaped member.

11. The home plate foundation form of claim 10 wherein said tray comprises three right angles, and said plurality of threaded members comprises three threaded members, each of which being disposed adjacent to a different one of said right angles of said tray.

12. The home plate foundation form of claim 1 further comprising at least one support disposed in the chamber of said outer frame for supporting said inner frame spaced from said outer frame.

13. The home plate foundation form of claim 1 wherein said inner frame is formed from a sheet metal material having a thickness of ⅛ inch, and said outer frame is formed from a sheet metal material having a thickness of ⅛ inch.

14. The home plate foundation form of claim 1 further comprising a removable cover plug comprising a base and synthetic turf.

15. The home plate foundation form of claim 1 further comprising at least one drain in fluid communication with said chamber of said inner frame.

16. The home plate foundation form of claim 1 wherein said surrounding sidewall of said outer frame comprises an outwardly-extending lip, and said surrounding sidewall of said inner frame comprises an outwardly-extending lip.

17. The home plate foundation form of claim 16 wherein said an outwardly-extending lip of said outer frame comprises a distal downwardly-extending portion.

18. A method for supporting a home plate on synthetic turf for playing baseball and softball, the method comprising:

providing the home plate foundation form of claim 1 in a support structure below the synthetic turf; and disposing the home plate in the home plate foundation form.

19. The method of claim 18 wherein the providing comprises excavating the support structure, placing the home plate foundation form in the excavated support structure, and placing cement between the inner frame and the outer frame of the home plate foundation form.

20. The method of claim 18 further comprising allowing water to drain from the chamber of the inner frame.

21. A method for supporting a home plate for playing baseball and softball, the method comprising:

providing the home plate foundation form of claim 1 in a support structure below synthetic turf;

adjusting the tray supported in the chamber in the inner frame, which inner frame is disposed in the outer frame; and supporting the home plate on the adjusted tray.

22. The method of claim 21 wherein the adjusting the tray comprises adjusting the tray so that an upper surface of the home plate is disposed even with an upper surface of synthetic turf.

23. The method of claim 22 wherein the adjusting comprises adjusting a plurality of threaded members disposed in the inner frame.

24. A method for adjustably supporting a home plate on synthetic turf, the method comprising:

excavating a portion of a support structure;

placing the home plate foundation form of claim 1 in the excavated portion of the support structure;

placing uncured cement between the inner frame and the outer frame of the home plate foundation form; and disposing synthetic turf over the cured cement between the inner frame and the outer frame.

25. The method of claim 24 wherein the home plate foundation form comprises a prefabricated home plate foundation form having the inner frame fixedly attached to the outer frame.

26. The method of claim 24 wherein the home plate foundation form comprises a drain extending between the inner frame and the outer frame.

27. The method of claim 24 wherein the placing comprises placing the uncured cement having a top surface even with a top surface of the inner frame and the outer frame.

28. The method of claim 24 wherein the disposing comprises disposing the synthetic turf over inner sides of the inner frame.

29. The method of claim 24 further comprising:

supporting the home plate on the tray.

30. The method of claim 29 further comprising:

adjusting the orientation of the tray to support an upper surface of the home plate even with an upper surface of the synthetic turf.

* * * * *